United States Patent [19]

Karashima

[11] 4,400,046

[45] Aug. 23, 1983

[54] REFRIGERATED SHOWCASE

[76] Inventor: Masashi Karashima, 88-5, Nakano, Ebina-shi, Kanagawa-ken, Japan

[21] Appl. No.: 243,454

[22] Filed: Mar. 13, 1981

[30] Foreign Application Priority Data

Feb. 6, 1981 [JP] Japan ..... 56-15827

[51] Int. Cl.[3] ..... A47B 77/08; A47F 3/04

[52] U.S. Cl. ..... 312/236; 312/116; 62/256

[58] Field of Search ..... 312/236, 116; 62/255, 62/256

[56] References Cited

U.S. PATENT DOCUMENTS

| | | | |
|---|---|---|---|
| 1,610,244 | 12/1926 | Bonaccolta | 62/255 |
| 2,466,286 | 4/1949 | Stultz | 62/255 |
| 3,128,609 | 4/1964 | Beckwith et al. | 62/256 |
| 3,186,185 | 6/1965 | Bently et al. | 62/255 |
| 3,232,072 | 2/1966 | Barroero | 62/256 |
| 3,403,525 | 10/1968 | Beckwith et al. | 62/256 |
| 3,542,445 | 11/1970 | Donker | 312/116 |
| 4,109,484 | 8/1978 | Cunningham | 62/256 |
| 4,141,611 | 2/1979 | De Leon | 312/116 |
| 4,271,680 | 6/1981 | Karashima | 62/256 |
| 4,288,992 | 9/1981 | Eliason | 62/256 |

FOREIGN PATENT DOCUMENTS

| | | |
|---|---|---|
| 2398170 | 2/1979 | France . |
| 7805464 | 2/1921 | Netherlands . |
| 487628 | 5/1970 | Switzerland . |

*Primary Examiner*—Victor N. Sakran

*Attorney, Agent, or Firm*—Wenderoth, Lind & Ponack

[57] ABSTRACT

A refrigerated showcase characterized in that curtains superposed on each other in a plurality of layers so that an air layer or layers may intervene therebetween, are equipped along a front surface of a path of a cold air flow for refrigerating goods within the showcase, across the front opening of the body of the refrigerated showcase. Spacers are provided on the curtains in order to maintain the curtains in spaced relationship.

7 Claims, 9 Drawing Figures

REFRIGERATED SHOWCASE

BACKGROUND OF THE INVENTION

The present invention relates to a refrigerated showcase, and more particularly to a refrigerated showcase of energy saving type that is favorably used in a supermarket or the like.

Heretofore, a refrigerated showcase in which a cold air flow is circulated along its bottom wall, rear wall and top wall and across its front opening to refrigerate the interior of the showcase, and preferably another cool air flow is circulated outside of and along the circulating route of the cold air flow to prevent the cold air flow from being warmed up, has been known.

In the case where the above-mentioned type of refrigerated showcase is used in a supermarket or other shops for displaying and storing fresh goods or the like, however, after the shop has closed at night, if the refrigerator of the refrigerated showcase is operated at the same condition as the operation during the business hours when the access to the interior of the showcase is necessary, then an unnecessary electric power will be consumed by the refrigerator. On the contrary, if the refrigerator is stopped in operation or is reset at a higher regulation point of temperature, then because of inflow of a warm ambient air into the showcase through the front opening, the temperature at the interior of the showcase would be raised up to an undesirable level. Therefore, it will be conceived to cover the front opening of the refrigerated showcase with a curtain after the shop has closed, for the purpose of protecting the goods within the showcase from being damaged and preventing the warm ambient air from entering the showcase, to avoid temperature rise at the interior of the showcase even when the refrigerating capability of the refrigerator is weakened.

However, if the curtain covering the front opening of the showcase is a single layer of curtain, a moisture in the atmospheric air will dew on the outside surface of the curtain contacting the atmospheric air because of an extremely large temperature difference between the inside and outside surfaces of the curtain, and hence waterdrops will fall along the curtain, resulting in contamination of a passageway in front of the showcase or goods accommodated in the front portion of the showcase. If the curtain is made of a gas-permeable material in order to prevent such dewing on the surface of the curtain, then the atmospheric air will air the refrigerated showcase, resulting in frosting on the compressor or the like in the refrigerator, and this necessitates defrosting operations and thus lowers the refrigerating efficiency.

OBJECT OF THE INVENTION

Therefore, it is one object of the present invention to provide an improved refrigerated showcase of energy saving type, provided with a simple structure for preventing temperature rise within the showcase after the shop has closed at night, perfectly achieving quality control for the goods within the showcase, and greatly saving on electric power consumption for refrigerating the interior of the showcase.

BRIEF SUMMARY OF THE INVENTION

According to one feature of the present invention, there is provided a refrigerated showcase in which curtains superposed on each other in a plurality of layers so that an air layer or layers may intervene therebetween, are equipped along a front surface of a path of a cold air flow for refrigerating goods within the showcase, across the front opening of the body of the showcase.

According to another feature of the present invention, there is provided a refrigerator showcase in which curtains superposed on each other in a plurality of layers with a spacer or spacers interposed between the adjacent curtains, are equipped along a front surface of a path of a cold air flow or refrigerating goods within the showcase, across the front opening of the body of the showcase.

Since the refrigerated showcase according to the present invention has the above-featured structure, in the case where the refrigerated showcase is used in a supermarket or other shop, after the shop has closed at night, the front surface of the passage of a cold air flow across the front opening of the showcase can be covered by the curtains in a plurality of layers, and thereby the goods within the showcase can be protected from being damaged externally and the warm ambient air can be prevented from entering the showcase. Therefore, even if the refrigerating capability of the showcase is weakened during the out-of-business hours, the temperature rise which may be otherwise caused within the showcase can be avoided.

Moreover, according to the present invention, since the curtain equipped along a front surface of a path of a cold air flow for refrigerating goods within the showcase is composed of a plurality of layers of curtains superposed on each other so that an air layer or layers may intervene therebetween, in addition to the effect of preventing a warm ambient air from entering the showcase by the respective layers of curtains, the intervening air layer can form a heat-insulating layer and thereby can prevent temperature rise at the interior of the showcase. Also, owing to the existence of the intervening air layer, the temperature difference between the outer surface of the outermost curtain exposed to the ambient air and the inner surface of the same curtain delimiting the intervening air layer is greatly reduced, so that moisture in the ambient air would not dew on the outer surface of the outermost curtain. Accordingly, the curtains can be made of a dense gas-impermeable material, and as a result, there is no fear that the ambient air may be introduced into the showcase. Therefore, frosting would not occur on the compressor or the like in the refrigerator of the refrigerated showcase, hence defrosting operations become unnecessary, and there is not a fear of lowering the refrigerating efficiency.

As described above, according to the present invention, since inflow of an ambient air into the refrigerated showcase is prevented, thereby keeping the interior of the showcase refrigerated and preventing the refrigerating capability of the compressor in the refrigerator of the refrigerated showcase from becoming degraded as by frosting, owing to the use of the plurality of the layers of curtains having an intervening air layer or layers therebetween, the working period of the compressor in the refrigerator during the out-of-business hours at night can be greatly shortened, and thereby an energy saving effect can be achieved.

BRIEF DESCRIPTION OF THE DRAWING

The above-mentioned and other features, objects and advantages of the present invention will become more apparent by reference to the following description of preferred embodiments of the invention taken in conjunction with the accompanying drawings, wherein.

DETAILED DESCRIPTION OF THE PREFERRED EMBODIMENTS

Figure 1:
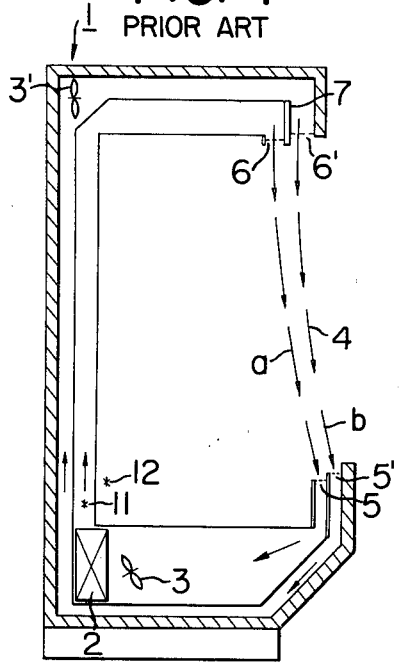
FIG. 1 PRIOR ART
FIG. 1 is a longitudinal cross-section view showing one example of a refrigerated showing to which the present invention is applicable.

Referring now to FIG. 1, reference numeral (1) designates a known refrigerated showcase, in which a cold air flow for refrigerating goods within the showcase and another cool air flow for preventing temperature rise of the first said cold air flow are respectively circulated from suction ports (5), (5') along a lower edge of a front opening of the showcase through ducts in a bottom wall, rear wall and top wall of the showcase and ejection ports (6), (6') along an upper edge of the front opening, back to the suction ports (5), (5') as shown by arrows a and b by the actions of a refrigerator (2) and fans (3), (3') contained in the refrigerated showcase, and thereby goods accommodated within the showcase (1) can be refrigerated.

Figure 2:
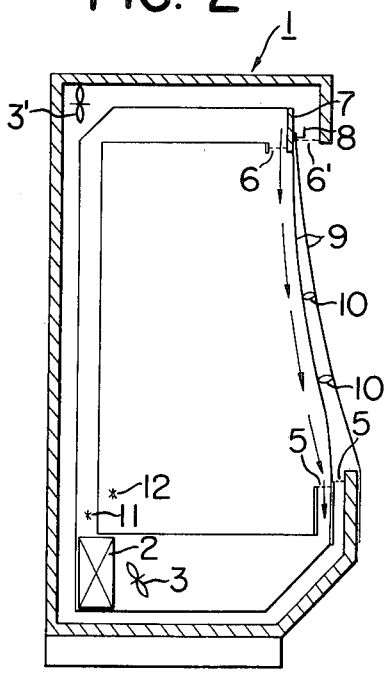
FIGS. 2 through 7 are longitudinal cross-section views showing various preferred embodiments of the refrigerated showcase according to the present invention.

In a first preferred embodiment illustrated in FIG. 2, on a front hanging wall (7) for guiding a cold air flow of the ejection port (6) of the cold air flow for refrigerating goods within the showcase at the top of a front opening (4) of the showcase, are disposed curtain hangers (8) at a desired interval along the widthwise direction of the front opening, and these curtain hangers (8) are adapted to be detachably engaged with mount pieces such as eyelets provided along a top edge of a curtain as will be described later.

Figure 8:
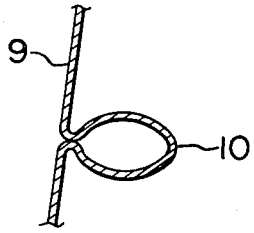
FIGS. 8 and 9 are longitudinal cross-section views showing spacer portions of the curtains of different types to be preferably used according to the present invention.
Figure 9:
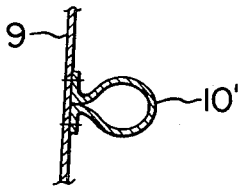

Reference numeral (9) designates curtains made of a densely woven fabric having little gas-permeability. Mounting pieces made of a synthesized resin sheet or like materials are provided at the upper edges of each of a pair of front and rear curtains (9), (9), and on a surface of either one of the front and rear curtains (9) opposed to the other curtain (9) are vertically provided spaced spacers (10) so that an air layer may intervene between the front and rear curtains (9), (9). As is apparent from FIG. 2, the spacers (10) prevent the cold air flow between ejection port (6) and suction port (5) from blowing the front face of the innermost curtain (9) against the rear face of the outmost curtain (9). Each spacer (10) could be formed by sewing the fabric of the curtain in the form of a tuck extending in the widthwise direction as shown in FIG. 8, or else it could be formed by securing a preliminarily shaped tuck piece (10') onto the fabric of the curtain by sewing as shown in FIG. 9. In the latter case, a cord havng a length equal to the width of the curtain could be used in place of the tuck piece (10'). It is to be noted that the curtains (9) could be used in a multi-layer form consisting of three or more layers.

In a supermarket or other shops where the above-mentioned refrigerated showcase is installed, when the business has terminated at night, the mount pieces provided along the top edges of the curtains (9) are engaged with the curtain hangers (8) disposed on the front hanging wall (7) of the ejection port (6) of the cold air flow for refrigerating goods within the showcase so that the path of the cold air flow for refrigerating goods within the showcase is covered by the curtains (9) as shown in FIG. 2, lighting lamps in the shop and within the refrigerated showcase are put out, a thermostat for the refrigerator (2) disposed on its downstream side within the duct of the cold air flow is switched from a thermostat for daytime use (11) whose preset temperature is as low as $-3°$ C.$\sim -2°$ C. to another thermostat for night use (12) whose preset temperature is higher than that of the daytime thermostat (11) such as, for example, 2° C.$\sim$3° C., and the fan (3') in the outside duct for the cool air flow is turned off.

In the above-described embodiment illustrated in FIG. 2, owing to the provision of the double curtains (9), (9), the ambient air is prevented from entering the interior of the showcase, also the interior of the showcase is kept refrigerated by the heat-insulation effect of the air layer formed between the curtains (9), (9), and thereby degradation in quality of the goods within the refrigerated showcase can be prevented. In addition, the intervening air layer between the above-described curtains (9), (9) takes an intermediate temperature between the room temperature in the shop and the temperature within the showcase, so that the temperature difference between the inner and outer surfaces of the outermost curtain faced to the passageway in front of the showcase is greatly reduced, and hence moisture in the ambient air would not dew on the outer surface of the outermost curtain. Moreover, since the inflow of the ambient air to the interior of the showcase is prevented by the curtains (9), (9) as described above, frosting on the refrigerator (2) or the like would not occur, hence defrosting operations become unnecessary, and so, the refrigerating capability of the refrigerator (2) would not be degraded.

It is to be noted that if the path of the cold air flow for refrigerating goods within the showcase is entirely covered by equipping the curtains (9) as described above to prevent the ambient air from entering the showcase and to keep the interior of the showcase refrigerated, and lighting lamps within the showcase are put out, the temperature within the showcase would be excessively lowered. However, by switching the thermostat for the refrigerator (2) to another thermostat for night use (12) whose preset temperature is adjusted higher than the preset temperature of the thermostat for normal use during the business hours as described above, the temperature within the showcase would not be lowered to an unnecessary extent, hence the pause time of the compressor in the refrigerator (2) becomes longer, and thereby an energy-saving effect can be achieved.

In a large shop such as a supermarket, a large number of refrigerated showcases are placed in juxtaposition, and in the respective showcases are equipped individual thermo-control devices for operation during business hours. Therefore, it is troublesome to change the preset temperatures of all of the respective thermo-control devices upon termination of the business hours and to again reset the temperature of all of the devices to the original preset temperature upon recommencement of the business. However, as described in connnection to the first preferred embodiment, by separately mounting another thermostat (12) for use during the out-of-business hours at night within the refrigerated showcase (1) and merely switching the circuit for the thermostat to the second thermostat (12) during the out-of-business hours at night, the operation for changing the preset temperature can be achieved in a simple manner. In this connection, convenience will be attained by making provision such that the thermo-control device for business hours and the thermo-control device for out-of-business hours may be switched jointly with switching on and off of a lighting device for displayed goods within the showcase, so that when the lighting device has been put out for the out-of-business hours, the thermo-control device for out-of-business hours having a higher preset temperature may be operated, whereas when the lighting device has been put on for lighting the goods within the showcase upon recommencement of business. the thermo-control device for business hours having a lower preset temperature may be operated. Moreover, with regard to the aforementioned thermo-control device for out-of-business hours, the operation will become more convenient if a single such device is equipped so as to operate in common to a plurality of refrigerated showcases.

Figure 3:
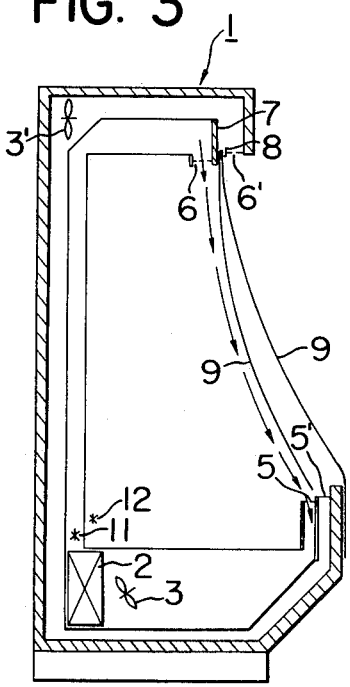

In the second preferred embodiment illustrated in FIG. 3, the present invention is applied to a refrigerated showcase, in which the path of a cold air flow for refrigerating goods within the showcase is not substantially vertical as is the case with the refrigerated showcase illustrated in FIGS. 1 and 2, but is inclined with the bottom end of the outermost curtain (9) draped over the lower, outer edge of the opening in the case. In this case, because of the illustrated geometrical configuration, there is no need to provide spacers (10) between the curtains (9). In this figure, component parts equivalent to those of the first preferred embodiment shown in FIG. 2 are given like reference numerals.

Figure 4:
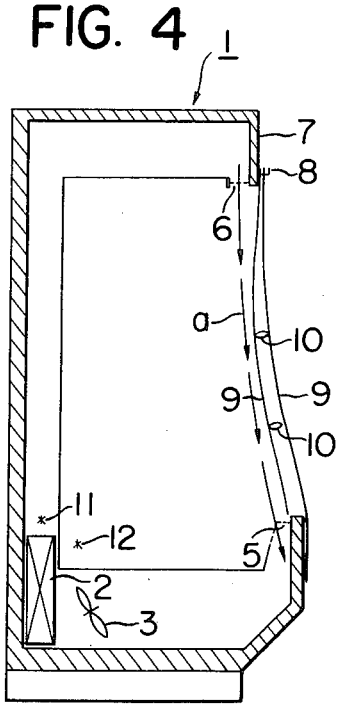
Figure 5:
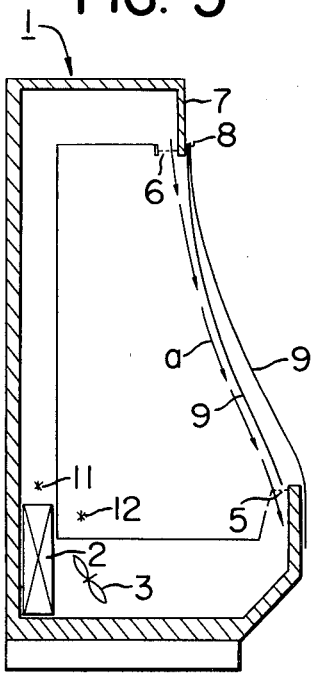

In the third and fourth preferred embodiments illustrated in FIGS. 4 and 5, respectively, the present invention is applied to a refrigerated showcase of the type in which only a cold air flow for refrigerating goods within the showcase is circulated through a single duct provided along the inside of the outer wall of the refrigerated showcase without employing another duct for circulating another cool air flow for preventing the cold air flow from being warmed up. In the refrigerated showcase shown in FIG. 4, the path of the cold air flow across the front opening is substantially vertical as is the case with the refrigerated showcase shown in FIG. 2, but in the refrigerated showcase shown in FIG. 5, the path of the cold air flow across the front opening is not substantially vertical, as is the case with the refrigerated showcase shown in FIG. 3. In these figures, component parts equivalent to those of the preceding preferred embodiments shown in FIGS. 2 and 3 are given like reference numerals.

Figure 6:
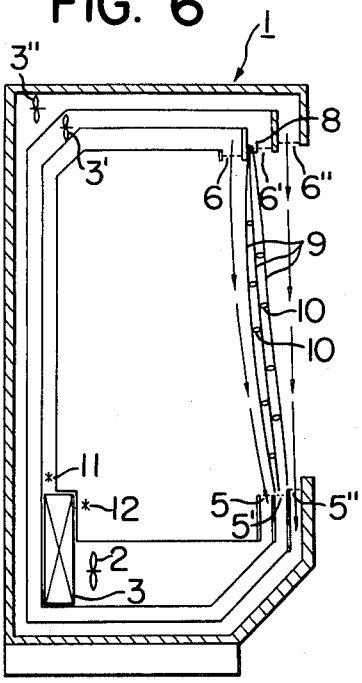

In the fifth preferred embodiment illustrated in FIG. 6, the present invention is applied to a refrigerated showcase of the type in which a primary cool air flow for preventing the cold air flow from being warmed up and a secondary cool air flow for the same purpose are circulated in parallel and around the path of the cold air flow for refrigerating goods within the showcase, and hence the curtains (9) are equipped in triple layers. In this figure, reference numerals (6'') and (5'') respectively designate a suction port, and an ejection port of the secondary cool air flow. In the illustrated embodiment, after the shop has closed, the curtains (9) are equipped along the front surface of the path of a cold air flow for refrigerating goods within the showcase, lighting lamps within the showcase are put out and the thermostat (11) is switched to the thermostat for night use (12). In addition, a fan (3') disposed within the duct for the primary cool air flow that is located outside of the duct for the cold air flow for refrigerating goods within the showcase, is stopped. Another fan (3'') disposed within the duct for the secondary cool air flow could be stopped or operated depending upon the necessity. In this figure, component parts equivalent to those of the preceding embodiments are given like reference numerals.

Figure 7:
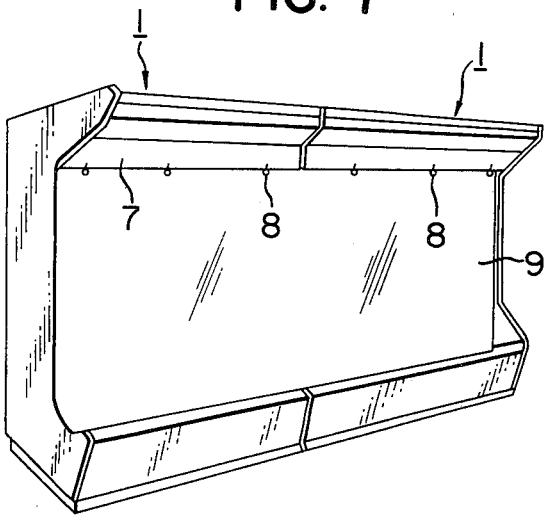

In the case where two or more refrigerated showcases are installed in juxtaposition and connected to each other, sometimes one set of multi-layer curtains having a width substantially equal to the sum of the widths of the connected showcases can be equipped across the entire front opening of the jointed showcase as shown in FIG. 7.

While the invention has been described above in connection to its preferred embodiments, it is a matter of course that the invention should not be limited only to such preferred embodiments, since various changes in design can be made without departing the spirit of the present invention.

What is claimed is:

1. In a refrigerated showcase, having a front opening, in which a cold air flow for refrigerating goods within the showcase is provided along a front surface thereof across the front opening, the improvement comprising:

a plurality of spaced flexible continuous gas-impermeable curtains having mutually facing surfaces, respectively freely hanging from the showcase along a top edge thereof, each extending across the entire front opening of the showcase so as to prevent fluid communication between the interior of the showcase, including the cold air flow, and the environmental atmosphere exterior to the showcase; and spacer means, fixed to and movable with one of the curtains at the facing surface thereof for separating the plurality of curtains from each other so as to maintain a continuous air space therebetween.

2. In a refrigerated showcase as in claim 1, the improvement wherein the spacer means comprises a plurality of vertically spaced spacers.

3. In a refrigerated showcase as in claim 2, the improvement wherein each of the plurality of spacers comprise a tuck sewn from the fabric of one of the plurality of curtains, extending horizontally across the front of the opening.

4. In a refrigerated showcase as in claim 2, the improvement wherein each of the plurality of spacers comprises a tuck-shaped member sewn onto the fabric of the curtain to which it is fixed, extending horizontally across the front of the opening.

5. In a refrigerated showcase as in claim 1, the improvement wherein the facing surfaces of the plurality of curtains have central portions and free outer, side and bottom edges which bound the central portions, the spacer means extending across the central portion of the one of the curtains so as to separate the central portions of each of the plurality of curtains.

6. In a refrigerated showcase having a front opening, in which cold air flow for refrigerating goods within the showcase is provided along a front surface thereof across the front opening, the improvement comprising:

a plurality of spaced flexible continuous gas-impermeable curtains having mutually facing surfaces, respectively freely suspended from the showcase alone a top edge thereof, each curtain extending across the entire front opening of the showcase so as to prevent fluid communication between the interior of the showcase, including the cold air flow, and the environmental atmosphere exterior of the showcase; and spacer means, fixed to and movable with at least one of the curtains at the facing surface thereof, for preventing the cold air flow from blowing any of the plurality of curtains into contact with another, so as to maintain a continuous air space between each pair of adjacent ones of the plurality of curtains.

7. In a refrigerated showcase having a horizontal upper edge and a horizontal lower edge below and horizontally outward displaced with respect to the upper edge, the upper and lower edges defining front opening therebetween in which cold air flow for refrigerating goods within the showcase is provided along a front surface thereof extending inclined to the vertical across the front opening, the improvement comprising:

a plurality of spaced flexible continuous gas-impermeable curtains, including an outer curtain and an inner curtain, having mutually facing surfaces, respectively connected to the showcase along a top edge thereof, each curtain extending across the entire front opening of the showcase so as to prevent fluid communication between the interior of the showcase, including the cold air flow, and the environmental atmosphere exterior to the showcase, the outer curtain at its bottom end being draped across the lower edge of the showcase, the inner curtain hanging freely behind the outer curtain, whereby the cold air flow is prevented from blowing the inner curtain into contact with the outer curtain, so as to maintain a continuous air space between the inner curtain and the outer curtain.

* * * * *